US006036621A

United States Patent [19]

Hancock

[11] Patent Number: 6,036,621

[45] Date of Patent: Mar. 14, 2000

[54] DIGIT GYM FOR THE EXERCISE OF HAND AND FINGER MUSCLES

[76] Inventor: Ted W. Hancock, 825 No. Ross, Santa Ana, Calif. 92701

[21] Appl. No.: 09/141,814

[22] Filed: Aug. 28, 1998

Related U.S. Application Data

[60] Provisional application No. 60/058,555, Sep. 11, 1997.

[51] Int. Cl.[7] ..... A63B 23/16; A63B 21/04

[52] U.S. Cl. ..... 482/47; 482/49; 482/121; 482/130; 601/40

[58] Field of Search ..... 482/44, 47, 48, 482/49, 114, 121, 129, 130; 601/40; 84/467, 469

[56] References Cited

U.S. PATENT DOCUMENTS

| | | | |
|---|---|---|---|
| 86,722 | 2/1869 | Armengol | 482/48 |
| 638,632 | 12/1899 | Griffin | 482/48 |
| 806,681 | 12/1905 | Kursheedt | 482/47 |
| 1,472,906 | 11/1923 | Gorrell | 482/48 |
| 3,606,316 | 9/1971 | Krewer | 482/47 |
| 4,220,327 | 9/1980 | Herbowy | 482/44 |

FOREIGN PATENT DOCUMENTS

| | | | |
|---|---|---|---|
| 296204 | 11/1991 | Germany | 601/40 |

*Primary Examiner*—Richard J. Apley
*Assistant Examiner*—Victor Hwang

[57] ABSTRACT

A hand exerciser comprising a rigid elongated horizontal base whose undersurface is covered by a soft, corrugatued material. Across the top surface of the base are longitudinally affixed three support walls so as to define two equal exercise spaces between the support walls which are braced apart by abutting crossrods. Affixed to and rising above the support walls in similiar plane are four opposite side guide plates with aligned holes, slots, and notches through which a variety of various shapes and strengths of simultaneously and latitudinally strung reaches transverse for exercising against. Also, adjustable rods transverse for palm down bracing of the hands. Anchor and guide bolts secure and guide the reaches. One support wall additionally includes an overhang portion of a rigid material shaped so as to stagger the reaches and to which are affixed four modified guitar machine heads for tightening and lessening of reach tension. At the bottom of each exercise space are two raised platforms with slots therein into which removable rectangular tabs are inserted so as to define eight spaces between the rectangular tabs within which isometric abduction and adduction exercises are performed. Two of the raised platforms removable tabs are spaced to accommodate small to medium hands while the other two are for medium to large hands thus resulting in a device which can isolate all of the digit joints and provide flexion, extension, abduction or adduction exercises for strengthening all of the intrinsic and extrinsic muscles of the hand.

12 Claims, 6 Drawing Sheets

DIGIT GYM FOR THE EXERCISE OF HAND AND FINGER MUSCLES

BACKGROUND—CROSS REFERENCES TO RELATED APPLICATIONS

This application claims the benefit of provisional patent application Ser. No. 60/058,555 filed Sep. 11, 1997.

BACKGROUND OF THE INVENTION

The purpose of a digit exerciser is to both rehabilitate the injured hand and strengthen the well hand. To accomplish this a device must be able to exercise all planes of movement; flexion, extension, abduction, adduction, plus opponens movement and do so from initially very weak exercises progressing to strong resistance exercises. It is important to be able to isolate each joint of the hand so that the specific muscle fibers that serve the joint can be exercised. The optimum device must also offer numerous options to the user and be able to accommodate all sizes of hands. Ability to exercise both hands simultaneously is advantageous.

Examples of previously known forms of exercisers are disclosed in U.S. Pat. Nos. 3,570,849, 3,606,316, and 4,220,327. These exercises do not provide a variety of reaches which can be gradually increased in tension from very weak to very strong. Nor do they provide for isolation of all the joints in the hand. Nor do these provide for exercise of all the heretofore noted planes of movement.

SUMMARY OF THE INVENTION

The primary purpose of the instant invention is to provide a digit gymnasium forum where one has several options as to how to isolate and exercise each joint of the hand thus the specific muscle fibers that serve the joint under consideration. It is a further object that all planes of digit movement be served by this device. It is a further object of this device that all forearm muscles can be exercised on this device. Furthermore, it is an object of this invention to allow both hands to exercise simultaneously if desired. Furthermore, it is an object of this invention to simultaneously provide multiple reaches from which the user can select on to their liking. Furthermore, it is an object of this invention to accommodate all sizes of hands. It is a further object to create a sturdy and long lasting device that can withstand the continual forces that will be exerted upon it. It is an object of this invention that no table is needed for operation but rather one can use their lap for placement of the device thus allowing mobility.

These together with other objects and advantages which will become subsequently apparent reside in the details of construction and operation as more fully hereinafter described and claimed, reference being had to the accompanying drawings forming a part hereof, wherein like numerals refer to like parts throughout.

DRAWING REFERENCE NUMERALS

50 Digit Gym
52 Base
54 Outer support wall
56 Inner support wall
58 Other Outer support wall
60 Raised Spine
62 Open anchors
64 Planar cover sheet on outer support wall 54
66 Planar cover sheet on inner support wall 56
68 Planar cover sheet on the other outer wall 58

70 Modified machine head with enlarged holes
72 Other modified machine head with enlarged holes
74 Modified machine head with slots therein
76 Other modified machind head with slots therein
78 Two reaches of nylon
80 Two reaches of small diameter elastic
82 Two reaches of larger diameter elastic
84 Four elastic band reaches
86 Circular hole
88 Guide plate affixed to support wall 54
90 Guide plate affixed to inner wall 56
92 Other guide plate affixed to inner wall 56
94 Guide plate affixed to support wall 58
96 Exercise space
98 Other exercise space
100 Eleven guide and anchor bolts
102 Two crossbars
104 Two rods
108 Planer sheet of soft material
110 Four raised platforms
112 Removable tabs
114 Framing
116 Four feet
117 Screws
118 Bolts

BRIEF DESCRIPTION ON THE DRAWINGS

DETAILED DESCRIPTION OF THE INVENTION

Figure 1:
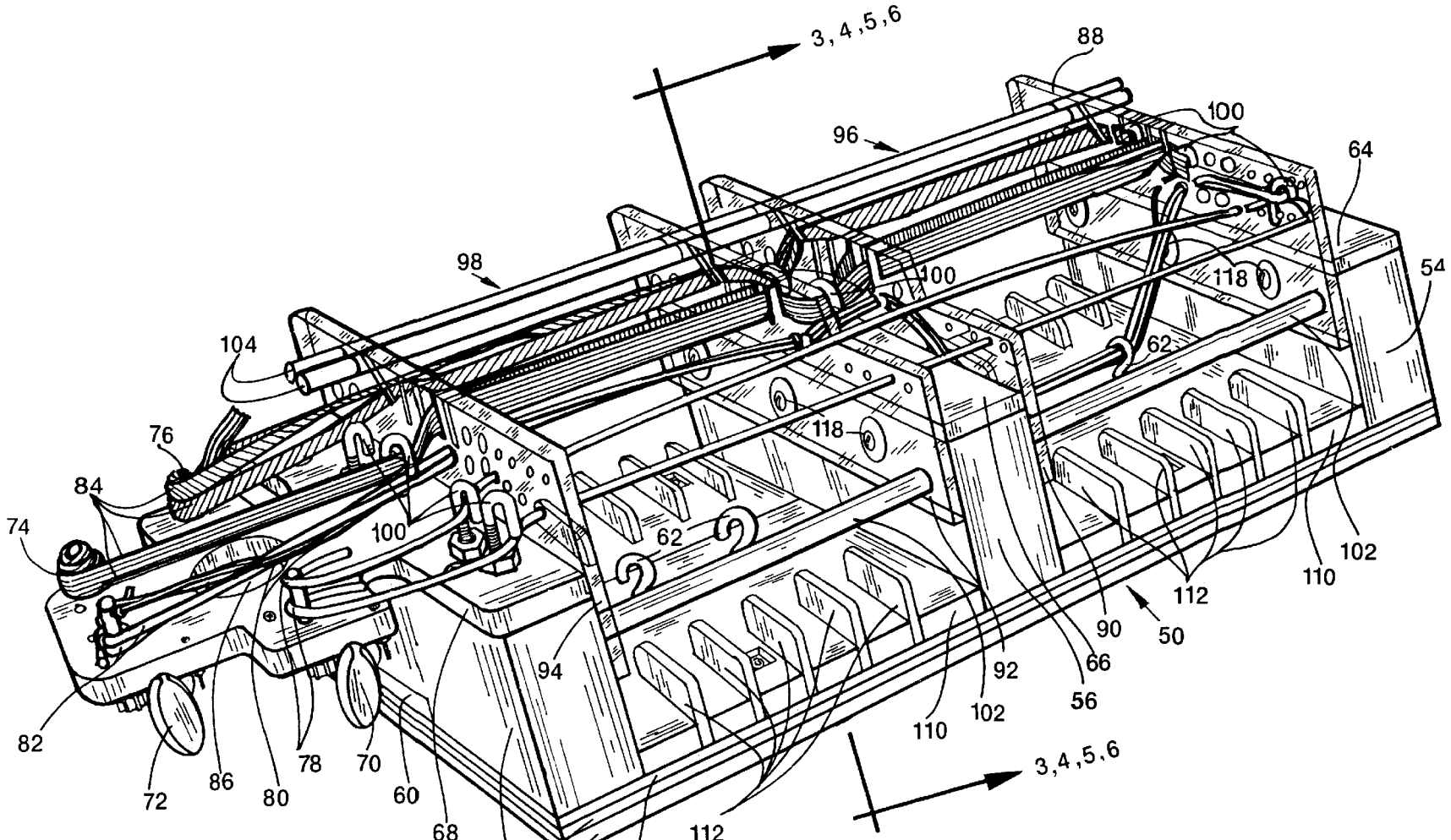
FIG. 1 is a perspective view of the top portion of the exercise device of the instant invention.

Referring to the drawing the numeral (50) designates the exercise device of the instant invention as shown in FIG. 1. The exercise device is comprised of an elongated, horizontal and rectangular base (52) made of a sheet of rigid material such as plastic, wood or other similar rigid material and possessing an undersurface side and a top surface side. Said base herein is made of plastic. Three support walls (54,56, 58) of equal length, width, height and spaced equal distance apart rise longitudinally from across the top surface of the base. Two of the support walls are outer support walls (54,58) being placed at the ends of the base and one middle support wall (56) placed equal distant between the two outer support walls. Said support walls define two separate exercise spaces (96,98) each sufficient in size to accommodate and exercise the human hand. The two outer support walls (54,58) each have an inner side facing an exercise space and an outer side facing outwardly from the device. The middle support wall has two inner sides each facing an exercise space. Said support walls can be made of plastic, wood or a similar sturdy material. Said support walls depicted herein are made of wood.

For added strength, a raised spine (60) is affixed to the middle of the top surface of the base and traverses the length of the base. The spine is exposed in both exercise spaces but is not exposed as it traverses beneath the three support walls (54,46,58). Where the support walls cross the raised spine (60) the walls are notched at their bottom so as to allow the raised spine to transverse uninterrupted the length of the base (52) and give rigid support to the device. On each of those two portions of the raised spine which are exposed between the three walls are placed two open hook anchors (62). There is a total of four open hook anchors. These four open hook anchors provide a means to remove and secure out of the way overhead reaches thus providing unimpeded space within which to perform exercises. On the top of each wall are affixed planar cover sheets (64,66,68), made of a rigid material, herein made of plastic. Said planar cover sheets provide an attachment means for attachment of guide and anchor bolts (100) and modified machine heads to the top surface of the support walls. The dimensions of the planar cover sheets sixty-four (64) and sixty-six (66) on walls fifty-four (54) and fifty-six (56) are exactly the same as to the top surface dimensions of the support walls which they respectively cover. The dimensions of planar cover sheet sixty-eight (68) covers the entire surface of the top of wall fifty-eight (58) to which said cover is attached and in addition thereto extends outwardly from the device so as to overhang the base. This overhang portion of planar cover sheet sixty-eight (68) assumes the shape of a modified guitar headstock. Planar cover sheet sixty-eight (68) also has greater dimension of height than planar cover sheets sixty-four and sixty-six (64,66). The additional height on planar cover sheet sixty-eight (68) gives added strength to the headstock portion which overhangs with no support beneath. Onto this modified headstock are placed four modified guitar machine heads (70,72,74,76). Each machine head is capable of accommodating a plurality of reaches.

For demonstration of versatility the device shown is strung with two reaches of nylon (78) affixed to machine head seventy (70), two reaches of small diameter elastic (80) affixed to machine head seventy-two (72), two reaches of larger diameter elastic (82) affixed to machine head seventy-two (72), four bands of elastic affixed to machine heads seventy-four (74) and seventy-six (76). With the exception of the nylon reaches, all others can be secured out of the way via the open hook anchors (62) or the notches in each guide plate (88,90,92,94). The modified machine heads are placed in such a way that their respective reaches stay out of the way of each other. This modification is accomplished by protruding a portion of the headstock on both sides of the headstock. Placement of the machine heads on the protruding portion allows for a staggering of placement of the modified machine heads. Each machine head has a worm for turning a gear which engages and rotates a vertical post which rises perpendicular to planar cover sheet sixty-eight (68). The vertical posts tighten or lessen tension in the plurality of reaches affixed thereto. The machine heads that share the same side of the headstock are identical in their modifications. The modifications are different as between the opposing sides of the headstock. Thus, the two modified machine heads seventy-four (74) and seventy-six (76) have a slot cut into the vertical rotating post from the top down to a depth that will accommodate placement therein of the plurality of elastic bands (84). Machine heads seventy (70) and seventy-two (72) have had existing holes enlarged so as to accommodate large diameter tensioned reaches. Placed in the center of the headstock portion of planar cover sheet sixty-eight (68) is a circular hole (86) for easy carrying and for securing the device by lock. To carry the device the headstock is grasped with the middle finger bent through the circular hole (86).

The device has four opposite positioned upright guide plates (88,90,92,94) which serve the function of guiding the reaches through transverse aligned holes, slots and notches therein. Guide plates eighty-eight (88) and ninety-four (94) are affixed to the inner sides of both outer support walls fifty-four and fifty-eight (54,58) and are identical in their configuration of holes, slots and notches placed therein. Affixed to both sides of the middle support wall fifty-six (56) are two inner guide plates identical as to each other but different in shape and possessing fewer holes than the outer two guide plates. All holes, slots and notches that the four guide plates do possess are similarly aligned to each other. All four guide plates are affixed so as to rise perpendicular in relation to the base (52) but in the same plane as the wall to which they are affixed (54,56 or 58). All four guide plates (88,90,92,94) are affixed to the sides of their respective support walls and continue rising above the top surfaces of the three support walls (54,56,58) and their respective planar cover sheets (64,66,68).

Some of the tensioned reaches are made from an elastic material such as rubber or synthetic elastic. The tensioned elastic reaches can assume the shapes of tubing, strings or bands. Other reaches are made of nylon or a similar material in the shape of strings. All reaches are strung in the same lengthwise, latitudinal direction stretching from their respective machine head (68,70,72 or 74) then through one of a number of holes, slots or notches in guide plate ninety-four (94) next crossing exercise space ninety-eight (98). Thereafter the nylon reaches may or may not go through holes, slots and notches in guide plates ninety and ninety-two (90,92) both being affixed to the middle supporty wall fifty-six (56). Here shown one strand of the nylon string reach, seventy-eight (78), does penetrate guide plate ninety and ninety-two (90,92) while one strand of the same nylon reach does not penetrate any holes in guide plate ninety or ninety-two (90,92). By not penetrating the holes on the inner guide plates there is greater ability for the nylon reaches to laterally stretch.

With the exception of the nylon strings all of the remaining reaches do penetrate and traverse through, on or upon the holes, slots and notches in guide plates ninety and ninety-two (90,92). All of the reaches next cross exercise space (96) and all reaches penetrate and traverse through guide plate ninety-four (94) and lastly all reaches are anchored onto guide and anchor bolts located on top of the outer support wall (54).

All planar cover sheets are attached to the top surfaces of the three support walls and each serve as an attachment means to secure guide and anchor bolts (100) which act as guides and anchors for the reaches. Said bolts have a shape similar to a parabola with one end of the parabola extending in a straight line. Threads are on that end that describes a straight line. The threaded end of the guide and anchor bolts (100) are placed in holes drilled into the top surface of the support walls (54,56,or 58) and planar cover sheets (64, 66, or 68). By penetrating into the top of the support wall the bolts have added rigidity and resistance to movement. The bolts are further secured by two nuts on each threaded end of the bolts. One nut is tightened against the planar sheet from below said sheet and the other nut tightened from above the planar cover sheet.

It is possible to exercise the digit muscles using only the guide and anchor bolts (100) as securing agents by lifting the reaches above the guide plates (88,90,92 or 94). The reaches are anchored to guide and anchor bolts (100) affixed to the top surface of the three support walls (54,56,58).

When the reaches are used, especially the nylon reaches, the support walls of the device are subject to forces which pull the outer support walls (54,56,58) toward the inner support wall (56). Two crossbars (102) which abut the middle support wall (56) and abut the inner side of the two outer support walls (54,58) so as to keep said outer support walls rigid and prevent any movement of the support walls toward each other are located directly beneath that area strung with nylon. Said crossbars (102) are fixed in place by the guide plates. Said guide plates have a hole cut into them which accommodates and holds in place the crossbars (102) which abut all three support walls (54,56,58).

The elastic string reaches can be quickly secured to the open hook anchors (62) located at the bottom of each exercise space thus allowing unobstructed space within which to exercise. If the user desires to exercise with just one of the elastic string reaches (80 or 82), the user can quickly secure the plurality of elastic band reaches (84) at that end of all four guide plates which has a notch cut therein. If there are surplus strings they can be secured as noted on the open hook anchors (62) located on the raised spines (60).

The device also comes with two rods (104) which can be inserted through any of the larger holes in the four guide plates (88,90,92,94). Said rods are made of a sturdy material such as wood, plastic or metal. Said rods shown herein are made of wood. Said rods provide the function of support for the hand when performing exercises. The palm of the hand rests on the rods as exercises are performed. The rods also provide strong resistance against the hand collapsing in on itself specifically when performing flexion exercises. Pressing against the rods allows one to keep joints straight while performing exercises in which this is a necessary part of muscle isolation. Also the rods can be used as a point of pressure for single digit isometric exercises. Also the rods can be used as an anchor for the digits while pushing or pulling against the reaches.

Figure 2:
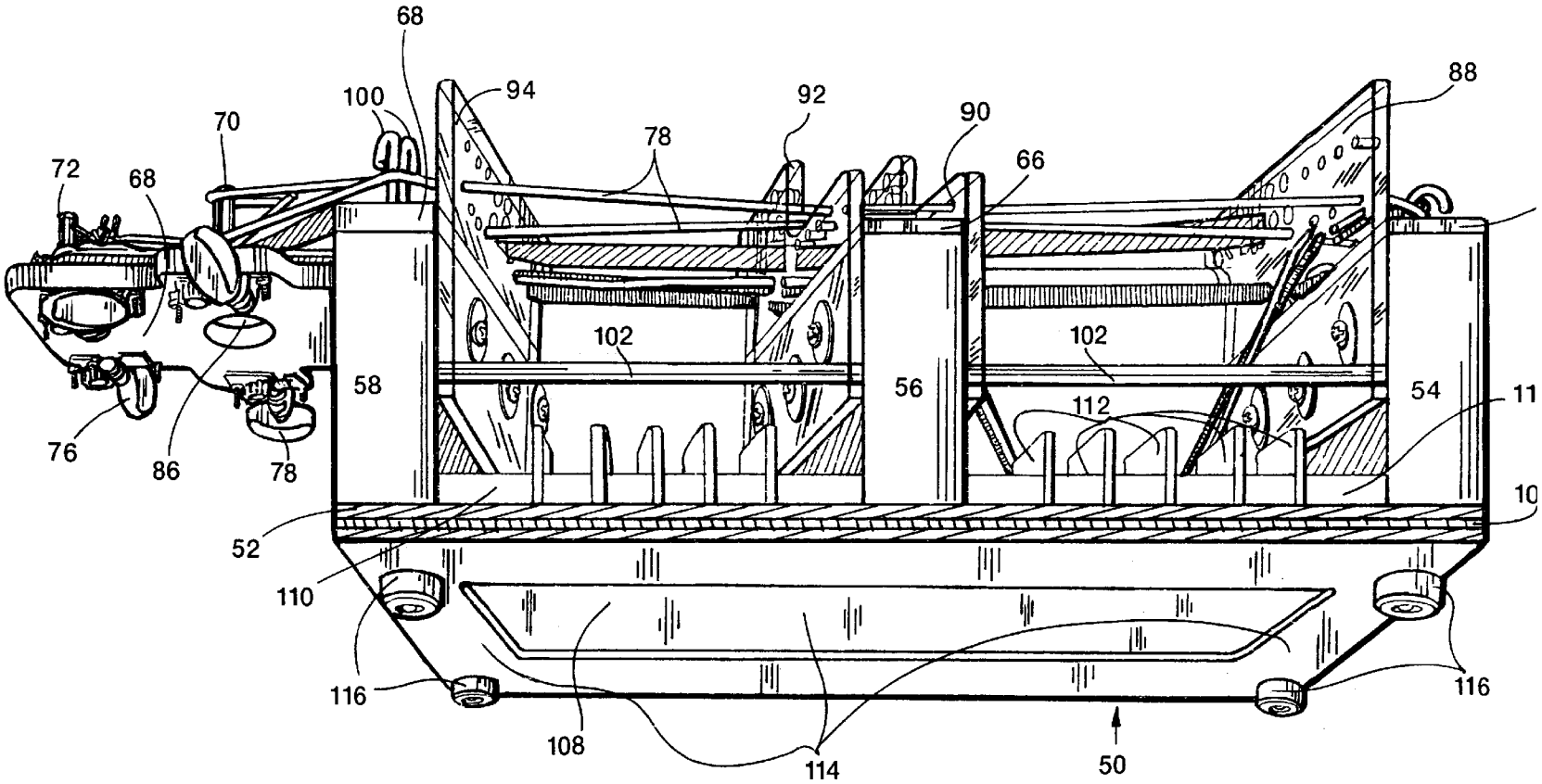
FIG. 2 is a perspective view of the bottom portion of the exercise device of the instant invention.

Affixed to the undersurface of the base (52) is a planar sheet of soft material (108) with opposing surfaces. FIG. 2 Said planar sheet of soft material is made of rubber or similar soft material. The planar sheet depicted herein is made of rubber. One side of this planar sheet of soft material (108) is smooth and is affixed to the undersurface of the base (52). The opposing side has a soft corrugated or a similar rough and broken surface. Against this corrugated surface the distal phalanges are extended and alternately flexed as the digits are unfurled and recoiled from a fist starting position. Also the corrugated rubber surface of the planar sheet of soft material (108) provides an excellent place for isometric extension exercises of the distal phalanges. The planar sheet of soft material (108) is framed (114) by strips of plastic which maintains a flat surface and inhibits wrinkling of the planar sheet of soft material (108).

Four raised platforms (110) which are the same height as the raised spine (60) are affixed to the top surface of the base (52). By being the same height as the raised spine (60) there is created a continuous flat surface in the bottom of each exercise space where exercises can be performed. The raised platforms (110) can be made of plastic, wood or a similar material. The raised platforms herein are made of plastic. Each of the raised platforms has five slots cut therein which penetrate the entire height of the raised platform (110) but only a portion of the width. The slots progress across the width toward the raised spine but do not reach the raised spine (60). Into the slots are placed removable rectangular tabs (112) which rise above the raised platforms thus forming a plurality of defined spaces within which passive isometric abduction and adduction exercises of the index, middle, ring and baby digit are performed. Pressing outward against the removeable tabs (112) is isometric abduction and pressing inward is isometric adduction. Ten slots in two of the raised platforms are spaced so as to accommodate the digits of two medium to large human hands when placed between the tabs (112) for abduction or adduction exercises. The ten slots in the remaining two raised platforms are spaced so as to accommodate the digits of two small to medium size hands.

Active resistance abduction and adduction exercises are available by using the four elastic band reaches (84). The elastic band reaches may be placed, one each, in the four vertical slots provided on each guide plate (88,90,92,94). This results in three spaces for placement of the digits. Because the middle digit does not move in abduction or adduction exercises when all digits are involved, both the middle and ring digit can be placed together between two elastic band reaches. In this position the hands can both simultaneously perform abduction exercises.

Figure 3:
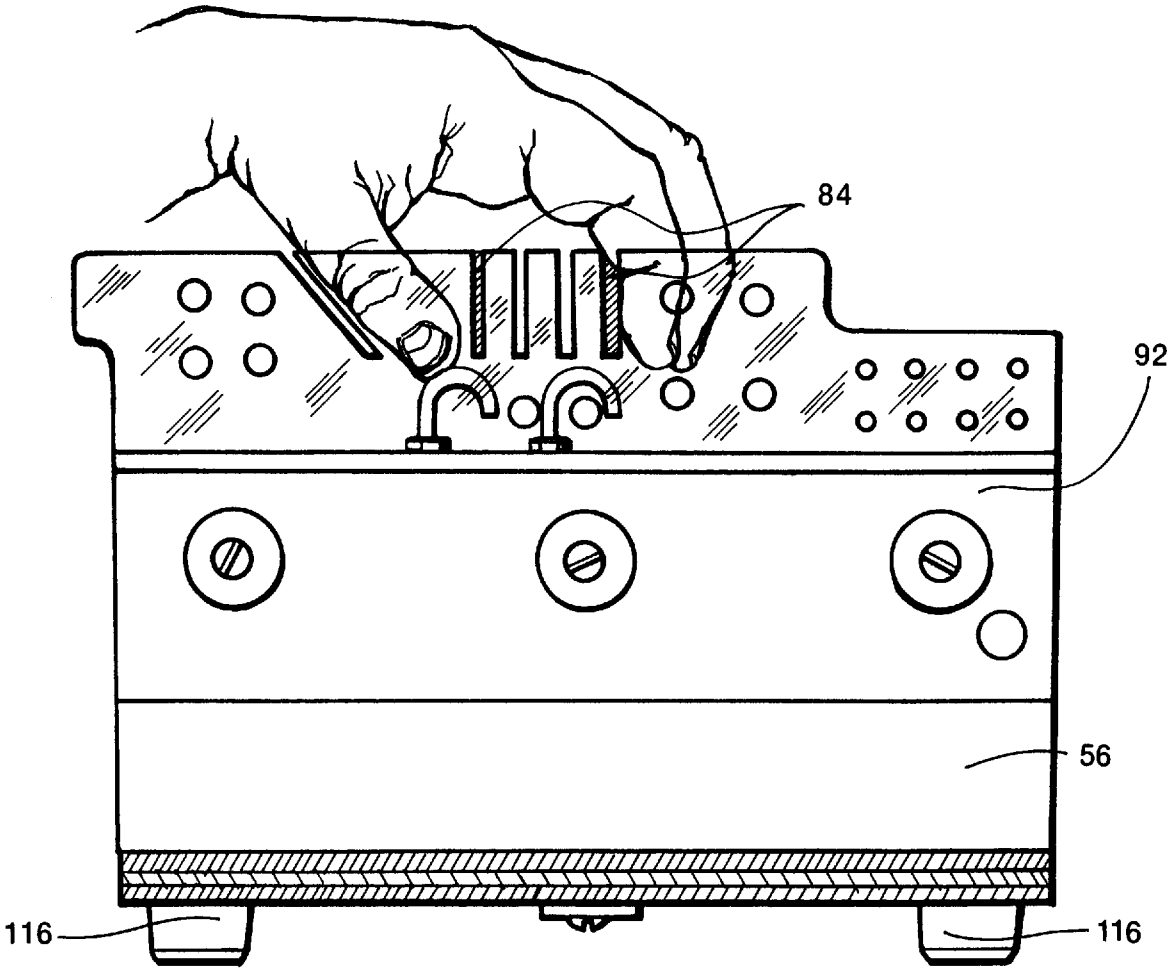
FIG. 3 is an elevation section view taken on line 3—3 of FIG. 1 depicting adduction.

If adduction is desired using the elastic band reaches it is best accomplished two digits at a time by spreading two digits beyond and over two bands placed in the outer vertical slots and then adducting. FIG. 3 By placing elastic band in the angled slot even greater adduction width can be achieved.

Tension in the reaches can be adjusted by the machine heads. One is not restricted to using the elastic bands. If the bands do not feel comfortable the user may string the device with small diameter elastic string or large diameter elastic string reaches and abduct and adduct against these reaches. Abduction and adduction of the digits occurs only at the metacarpophalangeal joints and does not occur at the interphalangeal joints.

Abduction and adduction of the thumb is best accomplished by suporting the palm either on the rods (104) or the guide plates, inserting the thumb between the elastic bands or string reaches and performing the exercise. Isometric abduction and adduction exercises of the thumb are also possible both against the planar sheet of soft material (108) affixed to the undersurface of the base (52), or by using the rods (104) as a pressure point. By placing the thumb beneath the rod and exerting upward pressure one is adducting. Placement of the thumb above the rod and exerting downward pushing pressure is abduction.

Figure 4:
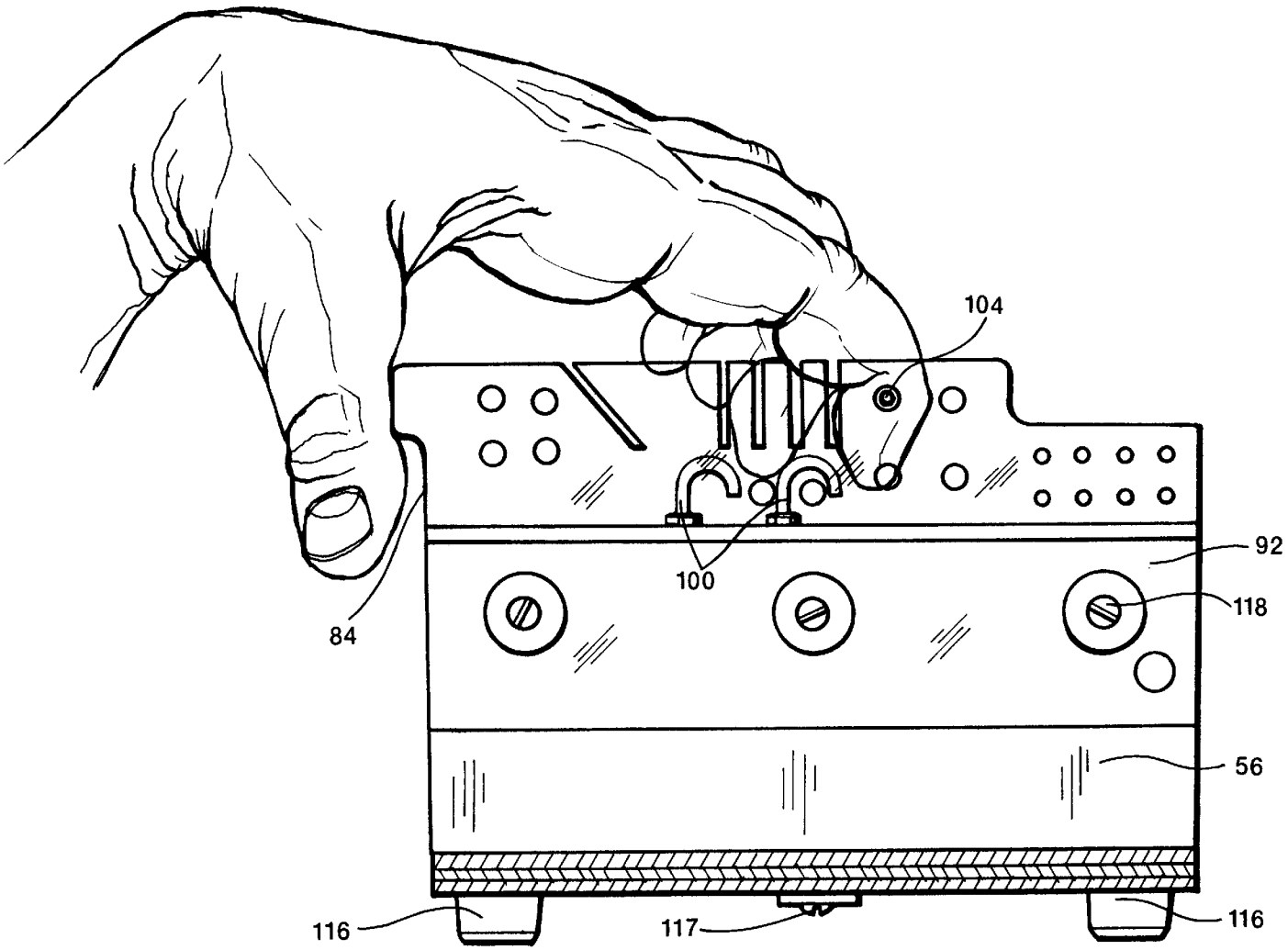
FIG. 4 is an elevation section view taken on line 3—3 of FIG. 1 depicting thumb flexion.

Flexion of the thumb can be achieved in a number of ways but the primary method involves stringing the elastic bands around the notched end of each guide plate (88,90,92,94) and placing the fleshy pads of the thumbs against the elastic band while one simultaneously holds the rods by ones distal interphangeal joints. FIG. 4 The rod would be on the opposite side of device. In this position one flexes the thumb toward the rod.

Extension of the thumb would have the hand resting palm down on the rod while the thumb is inserted between elastic bands in the vertical slots and extending against the band. One can adjust the resistance by extending against more than one elastic band.

This device can isolate and exercise the individual joints. There are five digits and three joints to each digit except the thumb thus there is a total of twenty-eight joints on each hand. Each joint is capable of being exercised on each of the four types of reaches thereby rendering one hundred thirteen ways to exercise on the device via the reaches alone. This does not include exercises performed either on the planar sheet of soft material (108) nor those exercises performed on the top surface of the raised platforms (110).

As noted, FIG. 1, depicts the device with all four types of reaches strung. Note that each reach is basically a loop thus there are always two strands of each reach when only one reach is strung. This allows the user to place the digits between the two strands and alternately exercise two or more digits.

Exercise of the proximal interphalangeal joint is accomplished by placing the palm of the hand on the rods holding the metacarpophangeal joint extended while one flexes and extends. The elastic bands (84) are helpful to use due to the broader surface area of the bands verses the string.

Figure 5:
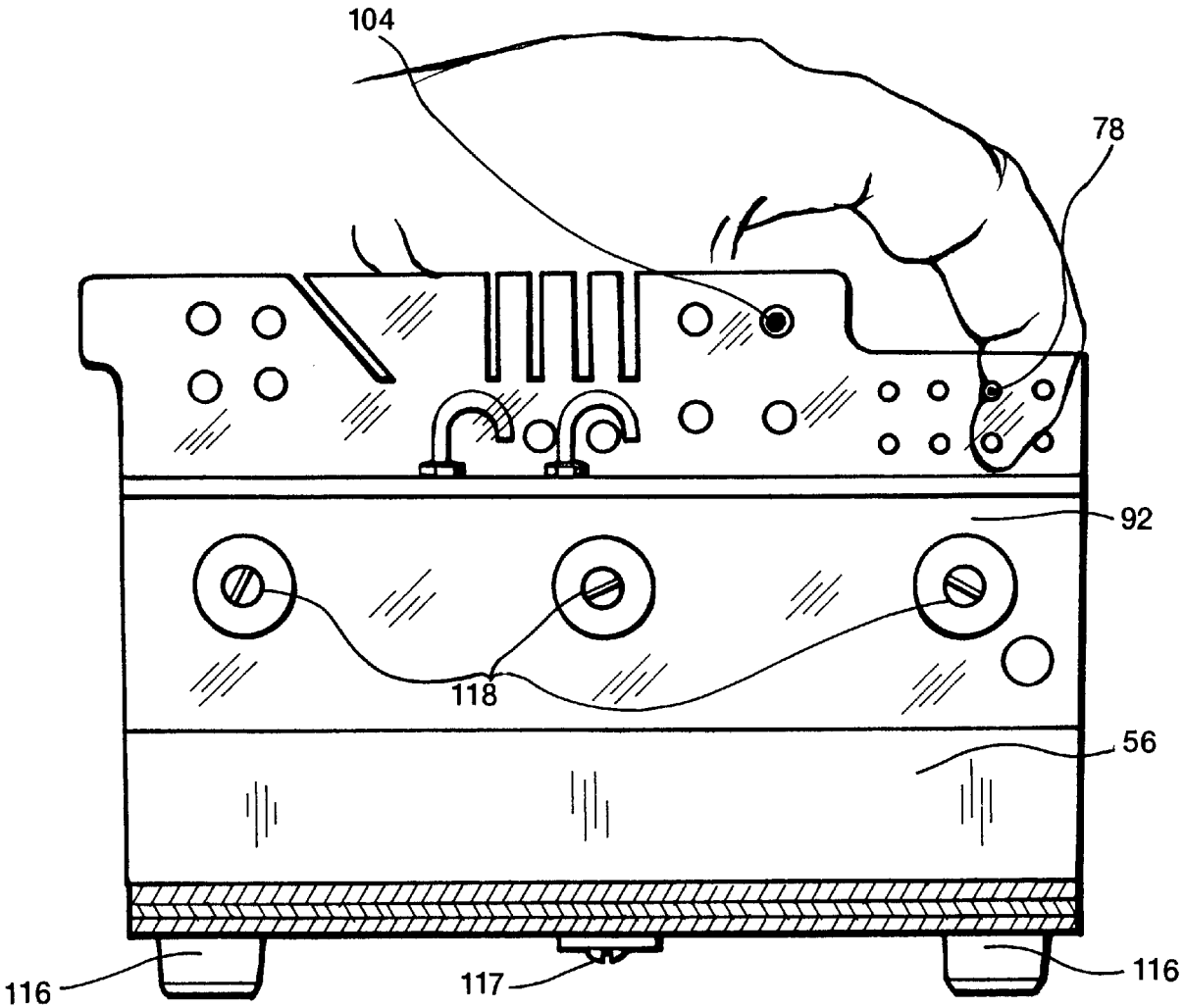
FIG. 5 is an elevation section view taken on line 3—3 of FIG. 1 depicting distal interphangeal flexion.

Exercise of the distal interphalangeal joint is more problematic than the other joints. This joint will not flex until the proximal joint is first flexed. This is natures way of ensuring that we have as big a grip volumn as possible. Therefore all exercises commence with the proximal joint already flexed. Additionally, the distal joint does not have as great a range of motion as the other digit joints. A good flexion exercise is available using the nylon reaches. FIG. 5 By placing the palm on the rods one can place the tip of the fleshy pad against the nylon and flex. If the nylon is too hard for the user, finger cots act as good protectorates.

One method of extension exercise of the distal extensors is accomplished by unfurling the digits across the corrugated surface of the planar sheet of soft material (108) affixed to the undersurface of the base (52). The digits should be unfurled across the grain of corrugution and not with the grain. By doing this exercise it is the tip of the dorsal surface of the fingernails which comes into contact with the device thus exercising those muscle fibers responsible for extension of the most distal part of the distal phalange. Flexion can also be accomplished by recoiling the digits against the planar sheet of soft material (108). Also isometric extension exercises of the distal joint are accomplished by holding the digit steady and exerting pressure via the nail tips against the planar sheet of soft material (108). Exercise of the distal joint is also accomplished using the reaches. One method of using the reaches would entail having the palm resting against the rods and flexing and/or extending against the elastic bands.

Another way to isolate the intrinsic extensors is achieved by placing the elastic band around the notches in the guide plates (88,90,92,94) and placing one or two rods through one of the four holes adjacent to the notches. Place the hand palm side down on the rod(s) with digits facing the angled slot, and both the metacarpophangeal and proximal interphangeal joints flexed but the distal interphangeal joint extended. In this position the distal interphangeal joints are immediately above the elastic band and remain extended throughout the exercise. Keeping the metecarpophangeal joint flexed one now extends the proximal interphangeal joint thus pressing the extended distal interphangeal joint against the elastic band.

One need not do alternating flexion and extension exercises but may only do flexion or only extension. If one desires to solely flex or solely extend against one strand of a reach, the other strand of the reach can be secured on the open hook anchors (62) or on the notches located at the end of each guide plate (88,90,92,94). The nylon reaches are not able to stretch enough to secure on the open hook anchors (62) and that is why they are strung on one side of the device where they need not be moved.

Figure 6:
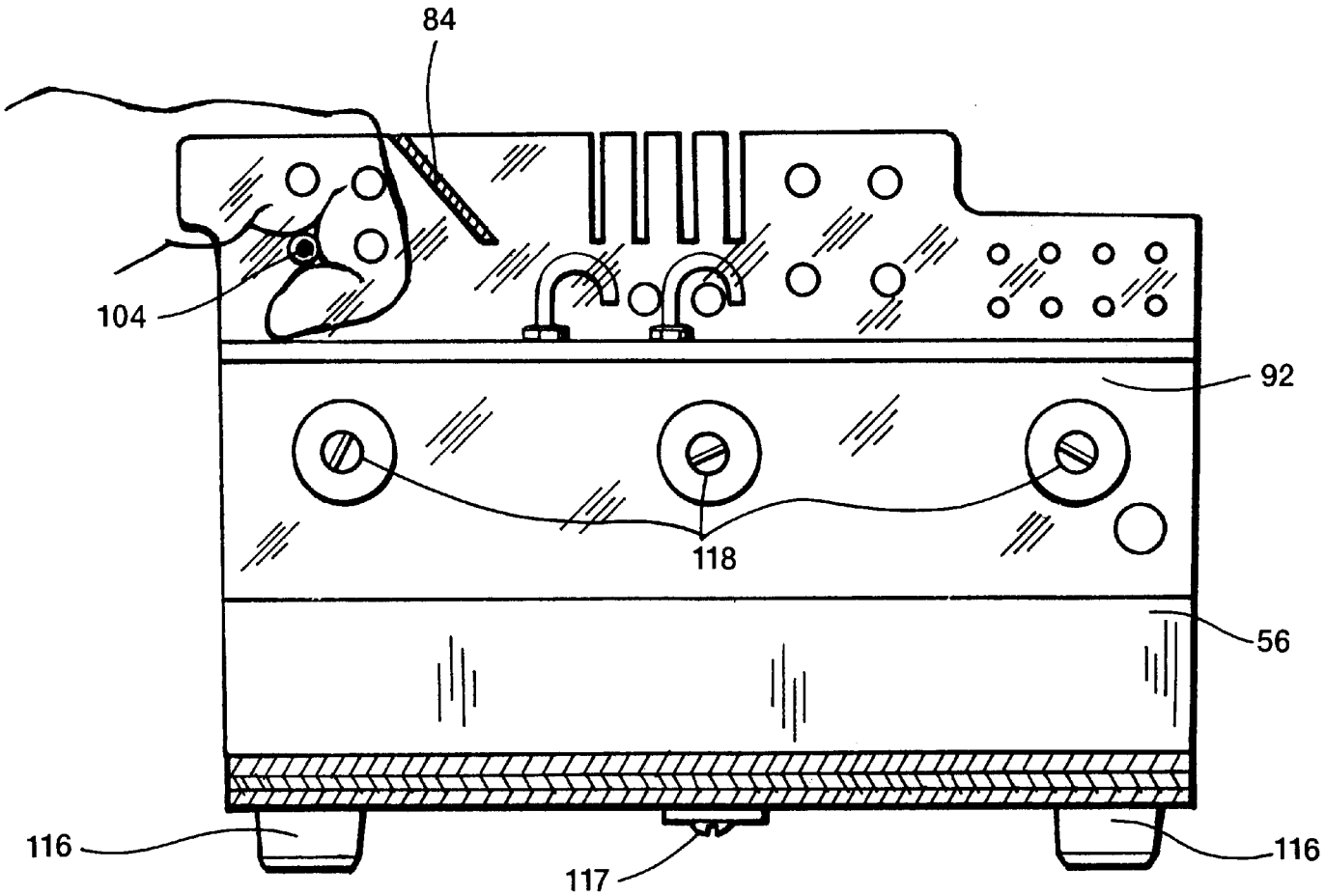
FIG. 6 is an elevation section view taken on line 3—3 of FIG. 1 depicting metecarpophangeal extension.

Exercise of the metacarpophalangeal joint is accomplished in a number of ways. Cut into the guide plates is one slot at an approximate forty-five degree angle to the other four vertical slots. The angled slot is especially good for exercises of the metacarpophalangeal joint. FIG. 6 By resting the palm on one or two rods (104), which are adjustable in their positioning, one can alternately flex and extend this joint by slipping the digits between two reaches of the elastic band (84). As noted one can solely flex, solely extend or alternate doing both. Further note that the guide and anchor bolts (100) located on the top surface of all three planar cover sheets (64,66,68) serve to anchor all the reaches in their respective slots when exercising. Without said guide and anchor bolts the reaches would not stay in their respective slots.

The guide and anchor bolts (100) provide another way to exercise the metacarpophalangeal joint, to wit, by securing any of the reaches solely by said guide and anchor bolts (100) and not utilizing any of the guide plate holes, slots, or notches the user can exercise this joint by raising the arm above the device to the stretching limit of the reach. Metacarpophalangeal joints can also be exercised against the nylon reaches.

Because the nylon reaches are hard to ones touch any exercise involving the dorsal surface of the digits, for example extension exercises, will usually require the use of a digit protectorate (106). The device comes with one digit protectorate (106) and instructions on making more that must be custom made to ones own digit circumference. Digit protectorates are strips of half inch wide rubber band wrapped one and a half times around the digit and glued. Wrapping one and half times allows the user the option of one layer or two of rubber band protection. The digit protectorate also can be used for isometric flexion and extension exercise protection. Specifically, the rods (104) and crossbars (102) are both able to sustain isometric pressure. Use of the digit protectorates (106) facilitates this exercise.

The raised platforms (60) when used without the removeable tabs (112) inserted therein, offers a flat surface at the bottom of each exercise space (96,98). On the raised platform opposite the crossbar (102) one can place the hands, palm side down, grasp a reach of ones choice from above and perform the exercise whereby the metacarpophalangeal joint is flexed and the interphalangeal joints are extended. One holds the reach across the finger pad. This exercise is unique in that the lumbricals and the interossi muscles both simultaneously flex the metacarpophalangeal joint while extending the proximal and distal interphalangeal joints.

Accomplishment of this exercise and the others noted herein result in stretching of the muscles as well as increased contraction strength. Of course strength is important for dexterity, speed and endurance but range of motion is a critical component of good joint health and digit abilities. Range of motion is achieved through stretching of the muscles. Stretching occurs simultaneously to the antagonist muscle(s) of the one being contracted.

The thumb's opponen muscle is exercised by using the elastic band reach thread around the notches at the end of each guide plates (88,90,92,94). The primary difference between exercise of the opponens verses the flexor is in the angle of the thumb as it pushes against the band.

The device has four rubber legs (116)one affixed to each corner of the undersurface of the base (52) and planar sheet of soft material (108).

The device is held together by screws (117) and bolts (118).

I claim:

1. A finger and hand exercise device comprising:

an elongate, rigid base having a longitudinal length sized to accommodate the width of at least two hands, said base having a top surface and an undersurface;

three support walls mounted to the top surface of said base, said support walls spaced equally to define two inner exercise spaces;

a plurality of reaches, at least one of said plurality of reaches selectively mounted to said support walls to extend substantially the longitudinal length of said base and across said exercise spaces;

means for guiding and securing said at least one mounted reach;

said guiding and securing means including a guide plate mounted to each said support wall, said guide plates having aligned apertures and slots therein;

at least one of said support walls further including means for adjusting the tension of each mounted reach; and means for adjustably supporting at least one of the hands of a user at a level relative to said at least one mounted reach whereby a user's hand is supported by said adjustable support means and a user is able to engage said at least one mounted reach in at least one of said exercise spaces with a portion of their hand or fingers and exercise muscles of their hand or fingers against the resistance to displacement provided by the tension of said at least one mounted reach.

2. The exercise device of claim 1, further comprising a soft material mounted to the undersurface of said base, said soft material having an exposed corrugated surface, wherein a user is able to engage the corrugated surface of said soft material with a portion of their hand in order to further exercise muscles of their hand or fingers.

3. The exercise device of claim 1, wherein said means for adjustably supporting at least one of the hands of a user comprises at least one rod, each rod selectively engaged with said guide plates.

4. The exercise device of claim 1, further comprising cross bars mounted between said support walls to resist movement of said support walls towards each other caused by the tension of said at least one mounted reach.

5. The exercise device of claim 1, wherein said guiding and securing means further includes means for engaging said at least one mounted reach within at least one of said exercise spaces between said support walls.

6. The exercise device of claim 1, further comprising a spine affixed to said base and extending substantially the longitudinal length of said base.

7. The exercise device of claim 6, wherein said means for engaging said at least one mounted reach between said support walls comprises at least one anchor within each exercise space affixed to said spine.

8. The exercise device of claim 6, further comprising a plurality of platforms;

each said platform affixed to the top surface of said base;

said spine having a top surface at a height above the top surface of said base;

each said platform having a top surface at the same height above the top surface of said base as the top surface of said spine; and each platform having a plurality of spaced slots therein.

9. The exercise device of claim 1, further comprising a plurality of vertically oriented tabs mounted to the top surface of said base, said tabs equally distributed between said two exercise spaces, wherein spaces between said tabs are adapted to accommodate a user's fingers for performing isometric abduction and adduction exercises.

10. The exercise device of claim 9, wherein said plurality of tabs comprises twenty tabs to create sixteen finger spaces.

11. The exercise device of claim 9, further comprising a plurality of platforms;

each of said platforms affixed to the top surface of said base;

each said platform having five spaced slots; and each said slot receiving one of said plurality of tabs.

12. The exercise device of claim 1, further comprising a plurality of feet mounted thereto.

* * * * *